US005691745A

United States Patent [19]

Mital

[11] Patent Number: 5,691,745

[45] Date of Patent: Nov. 25, 1997

[54] LOW POWER PIXEL-BASED VISUAL DISPLAY DEVICE HAVING DYNAMICALLY CHANGEABLE NUMBER OF GRAYSCALE SHADES

[75] Inventor: Amit Mital, Redmond, Wash.

[73] Assignee: Microsoft Corporation, Redmond, Wash.

[21] Appl. No.: 369,723

[22] Filed: Jan. 6, 1995

[51] Int. Cl.[6] ..... G09G 5/00

[52] U.S. Cl. ..... 345/148; 345/89; 345/201; 348/790

[58] Field of Search ..... 345/147, 148, 345/87, 88, 89, 98, 201, 63; 348/742, 743, 790, 791, 800, 802, 803

[56] References Cited

U.S. PATENT DOCUMENTS

| | | | |
|---|---|---|---|
| 4,559,535 | 12/1985 | Watkins et al. | 345/148 |
| 4,769,713 | 9/1988 | Yasui | 345/148 |
| 5,053,764 | 10/1991 | Barbier et al. | 345/148 |
| 5,122,783 | 6/1992 | Bassetti, Jr. | 340/701 |
| 5,185,602 | 2/1993 | Bassetti, Jr. et al. | 340/793 |
| 5,293,159 | 3/1994 | Bassetti, Jr. et al. | 345/149 |
| 5,298,915 | 3/1994 | Bassetti, Jr. et al. | 345/149 |
| 5,313,224 | 5/1994 | Singhal et al. | 345/89 |

*Primary Examiner*—Richard Hjerpe
*Assistant Examiner*—Kara Farnandez Stoll
*Attorney, Agent, or Firm*—Lee & Hayes, PLLC

[57] ABSTRACT

An inexpensive, low power visual display device has m n-bit/pixel frame buffers that hold m sets of pixel data, where m>1, and an n-bit controller for switching among the m n-bit/pixel frame buffers at a selected rate during a display cycle. The controller outputs a composite stream of the m sets of pixel data. A display having a matrix of pixels is coupled to the controller to receive the composite stream. The pixels are turned on and off in response to the composite stream of pixel data. Individual pixels have a grayscale shade reflecting an average duration that the individual pixel is on. The visual display device produces $m\times(2^n-1)+1$ grayscale shades, including white. The multi-buffer display device can be optimized in a manner which reduces power consumption or increases the number of gray scale colors in comparison to prior art single frame buffer visual display devices. A method for operating visual display devices is also disclosed.

12 Claims, 3 Drawing Sheets

LOW POWER PIXEL-BASED VISUAL DISPLAY DEVICE HAVING DYNAMICALLY CHANGEABLE NUMBER OF GRAYSCALE SHADES

TECHNICAL FIELD

This invention relates to visual display devices, such as liquid crystal display (LCD) devices, that are used in portable computing and communication machines. More particularly, this invention relates to techniques for reducing power consumption and dynamically increasing the number of grayscale shades in visual display devices.

BACKGROUND OF THE INVENTION

Visual display devices are used in computers to present information in visual form to the user. This invention is particularly directed to low power pixel-based visual display devices used in portable computers (e.g., laptops, notebooks, and palmtops) and portable communication devices (e.g., personal digital assistants and pagers). One example pixel-based visual display device employed in such portable equipment is a liquid crystal display (LCD) device.

One important design consideration for portable computers and communication devices is power consumption. It is desirable to design portable computing machines to consume very little power during operation, thereby extending the duration of usage between battery charges. Visual display devices represent a significant portion of the power consumption for the entire portable machine. There is an on-going need to design visual display devices with low power consumption.

Other important design considerations are quality and expense. It is desirable to reach the appropriate compromise between the quality of the LCD devices and their cost for any given portable device. For instance, laptop computers typically employ comparatively high quality, expensive displays, whereas pagers typically use comparatively low quality, inexpensive displays. In any event, at each display category, there is a continuing goal to develop higher quality, lower cost visual display devices that consume less power.

Conventional LCD devices convert a string of digital data into visual information that can be displayed on the screen. For efficient handling, the data is first organized in a memory according to a preset format representative of the screen layout. The formatted data pattern is then efficiently transferred to the visual display device for immediate display. The data is sent to the screen many times per second to "refresh" the screen.

FIG. 1 shows an example prior art LCD device 10 having a memory 12, a single 2-bit/pixel frame buffer 14 formed in the memory, a 2-bit controller 16, and a display 18. LCD device 10 further includes a microprocessor 15 coupled to an address/data bus 17, which also interconnects memory 12 and controller 16. A set of pixel data is stored in frame buffer 14 in a preset format corresponding to pixel location in display 18. A pixel element is either on or off. With two bits of data being provided for each pixel, the LCD device is capable of producing four grayscale shades: white, light gray, dark gray, and black. Full color shades of white and black are achieved by leaving the pixel "on" or keeping the pixel "off" at all times. Partial color shades of light gray and dark gray are achieved by turning the pixel "on" part of the time and "off" the remaining portion so that the eye perceives a shade that is somewhere between white and black.

In the illustrated conventional LCD device 10, the controller 16 repeatedly accesses frame buffer 14 three times at a rate of approximately 27 Hz during one display cycle. Each access iteration for a given frame buffer occurs at a rate of approximately 80 Hz (i.e., 27×3). Depending upon the value of the two bits in the frame buffer 14, the corresponding pixel is turned on a certain percentage of time during a frame cycle. For instance, the bit value "11" turns the pixel on during all three display iterations, "10" turns the pixel on two of the display iterations and off the third display iteration, "01" turns the pixel on only one of the display iterations and off the remaining two display iterations, and "00" leaves the pixel off during all three display iterations. The larger fraction of time the pixel is on during the frame cycle (i.e., during the three display iterations), the lighter the pixel appears. Table 1 summarizes this operation.

TABLE 1

One Display Cycle of a Prior Art LCD Device Having a 2-Bit/Pixel Frame Buffer

| Display Iteration I | Display Iteration II | Display Iteration III | Grayscale Shade |
|---|---|---|---|
| 00 | 00 | 00 | Black |
| 01 | 01 | 01 | Dark Gray |
| 10 | 10 | 10 | Light Gray |
| 11 | 11 | 11 | White |

It is noted that the pixel is turned on and off within one display cycle at approximately 27 Hz, which appears continuous to the human eye. The human eye can only discern discrete frames at approximately 10 frames/sec.

The illustrated prior art LCD device has some limitations. During each display iteration, the controller must read two bits of information per pixel, even though the information remains constant for all three iterations. This results in unnecessary memory reads, causing an undesired waste of power.

The 2-bit/pixel frame buffer is also limited in that it can produce only four grayscale shades. To achieve a larger number of grayscale shades, designers have traditionally turned to more expensive LCD devices, such as those employing 4-bit controllers and 4-bit/pixel frame buffers. The 4-bit/pixel LCD device produces 16 grayscale shades. Unfortunately, this larger LCD device consumes more power and is more expensive. The 4-bit/pixel LCD device is therefore not a workable option for portable devices where expense and energy consumption are high priorities.

SUMMARY OF THE INVENTION

This invention provides an inexpensive, low power visual display device with improved quality in terms of an increased number of grayscale shades. The visual display device has m n-bit/pixel frame buffers that hold m sets of pixel data, where m>1, and an n-bit controller for switching among the m n-bit/pixel frame buffers at a selected rate during a display cycle. The controller outputs a composite stream of the m sets of pixel data. A display, having a matrix of pixels, is coupled to the controller to receive the composite stream. The pixels are turned on and off in response to the composite stream of pixel data. Individual pixels have a grayscale shade reflecting an average duration that the individual pixel is on and off. The visual display device produces $m\times(2^n-1)+1$ grayscale shades, including white.

The multi-buffer visual display device can be optimized in a manner which reduces power consumption or increases the number of gray scale colors in comparison to prior art single frame buffer visual display devices.

According to another aspect of this invention, a method for operating a visual display device by toggling among multiple frame buffers to improve performance and/or conserve power is also described.

DETAILED DESCRIPTION OF THE PREFERRED EMBODIMENTS

Figure 1:
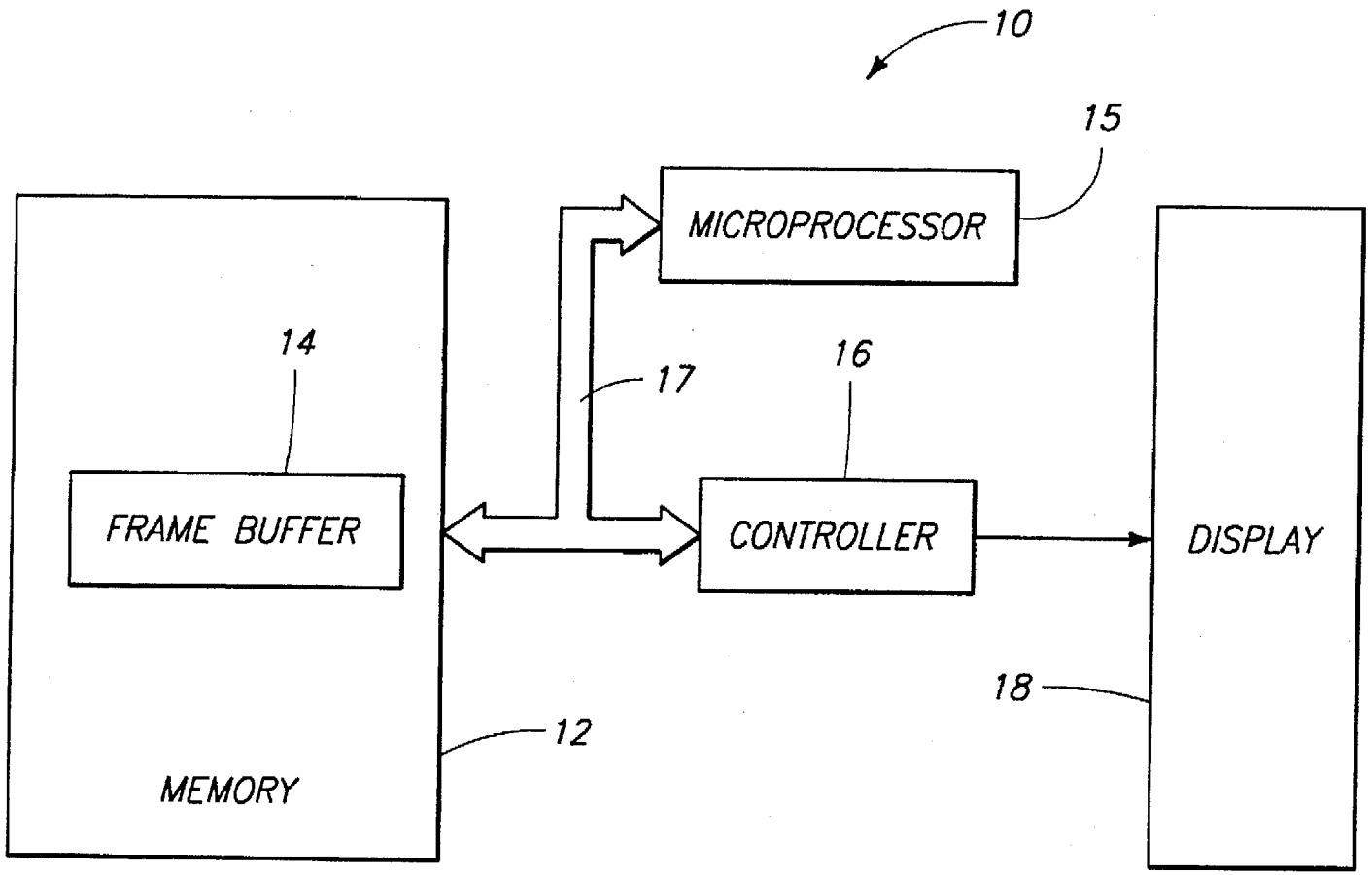
FIG. 1 PRIOR ART
FIG. 1 is a block diagram of a prior art LCD device.
Figure 2:
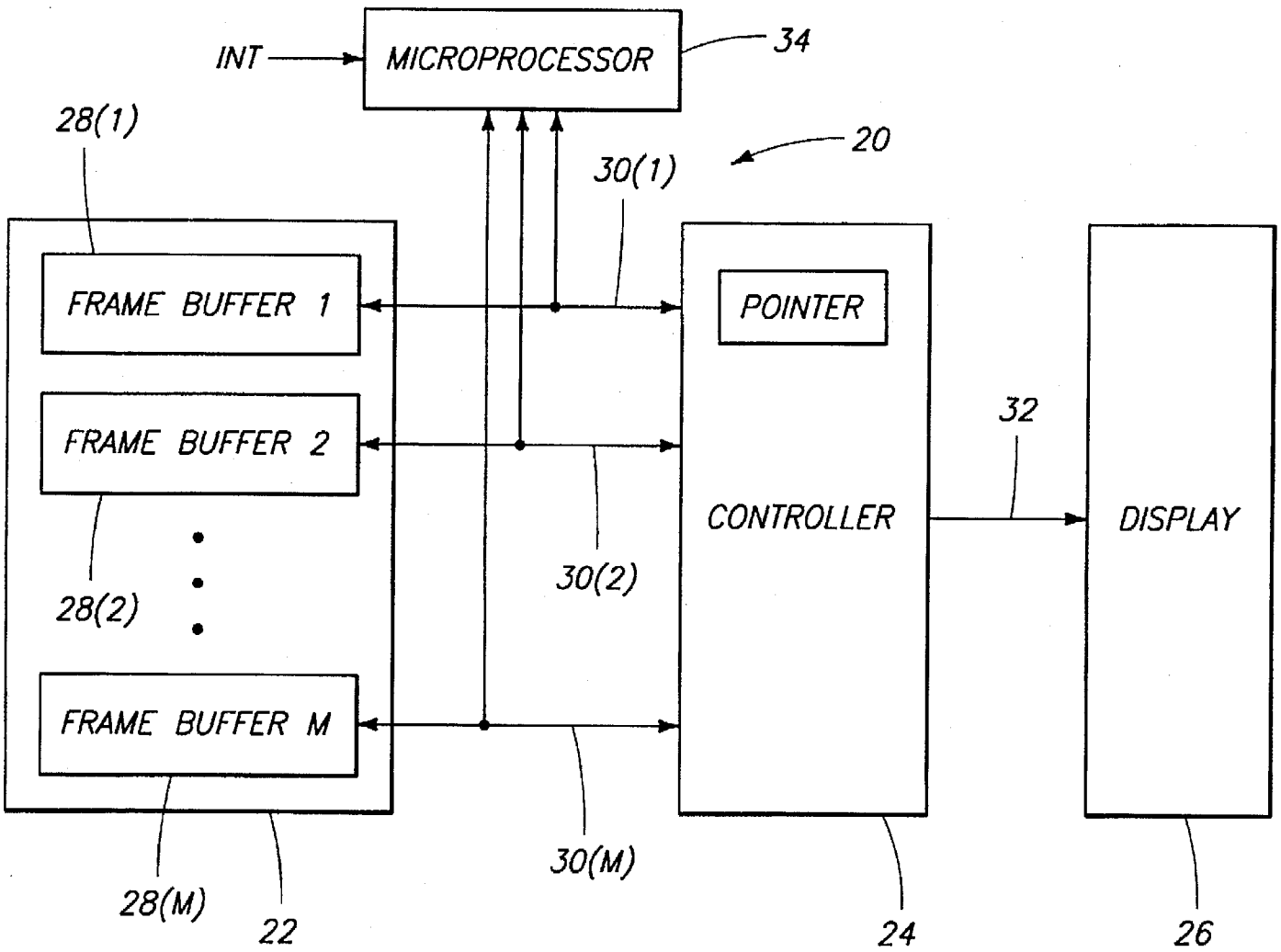
FIG. 2 is a block diagram of an LCD device according to this invention.

FIG. 2 shows a visual display device 20 constructed according to this invention. Visual display device 20 is particularly designed as an LCD device used in portable computers, personal digital assistants, pagers, calculators, and other hand-held electronic products. The invention is described in the context of a low cost, low power LCD device used in personal digital assistants, pagers, and the like, that have limited numbers of grayscale shades. However, the principles and techniques of this invention can be used to improve more sophisticated visual display devices, including color displays.

Visual display device 20 includes a memory 22 which is preferably formed of RAM (Random Access Memory), a controller 24, a display 26, and a microprocessor 34. Display 26 includes a screen and associated controller components that converts digital data received from controller 24 into visual information used by the screen to depict various images. The display preferably has a matrix of pixels, with an example resolution of 320×240 pixels.

Memory 22 includes multiple n-bit/pixel frame buffers 28(1), 28(2), . . . , 28(m). Each frame buffer holds a set of pixel data in a preset format corresponding to pixel location in display 26. Each frame buffer holds n bits per pixel and is capable of producing $2^n$ grayscale shades independently of the other frame buffers. As an example, a single 2-bit/pixel frame buffer can produce four grayscale shades in the manner described above in the Background of the Invention section. By employing multiple n-bit/pixel frame buffers, however, the LCD device of this invention is capable of producing more than $2^n$ grayscale shades, as is described below in more detail.

Controller 24 is an n-bit controller suitable for handling the n-bit/pixel data kept in individual frame buffers. The frame buffers 28(1)–28(m) are coupled to controller 24 via address/data (A/D) lines 30(1), 30(2), . . . , 30(m), which can be formed as discrete lines or as one or more buses. Microprocessor 34 is also coupled to A/D lines 30(1)–30(m). Controller 24 is coupled to display 26 via pixel data lines 32. A memory pointer for locating the individual frame buffers in memory 22 is maintained in controller 24.

According to this invention, controller 24 switches among the m n-bit/pixel frame buffers 28(1)–28(m) at a selected rate during a display cycle. The selected rate is preferably greater than or equal to 10 Hz, the threshold limit at which a human eye can discern between continuous display and discrete flickering. When n>1, the controller 24 accesses the same frame buffer $2^n-1$ times during the display cycle. For instance, if 2-bit/pixel frame buffers are employed, the controller accesses each frame buffer three times (i.e., $2^2-1=3$).

In a preferred implementation, microprocessor 34 receives an interrupt signal INT from a timer (not shown) which is used to coordinate switching among the buffers. The interrupt can be scheduled at the selected rate for each change over, with an example rate being greater than or equal to 10 Hz. An interrupt handler within microprocessor 34 writes a memory pointer to controller 24 upon receipt of the interrupt. The memory pointer identifies a location within memory 22 that holds the next desired frame buffer, thereby allowing controller 24 to rapidly switch between the frame buffers.

The controller outputs a composite stream of the m sets of pixel data over line 32 to display 26. The pixel data is used to turn "on" or "off" corresponding pixels in the display matrix to create a variety of grayscale shades. More particularly, the multi-buffer LCD device produces the following number of grayscale shades, including white:

$$\text{No. of Shades}=m\times(2^n-1)+1.$$

Using this formula, if three 2-bit frame buffers are used, the LCD device 20 can produce ten different grayscale shades, including white (i.e., $3\times(2^2-1)+1=10$).

The LCD device of this invention can advantageously be optimized in a manner which reduces power consumption or increases the number of grayscale shades in comparison to prior art single buffer visual display devices. These two device optimizations are described separately below.

Optimization Option 1: Reducing Power Consumption

For purposes of explanation, assume that LCD device 20 is configured with three 1-bit/pixel frame buffers 28(1), 28(2), and 28(3). Controller 24 switches among the three buffers at a rate of approximately 80 Hz during one display cycle. The controller accesses each frame buffer once (i.e., No. of Accesses=$2^n-1=2^1-1=1$) before changing to the next frame buffer.

The controller accesses a first frame buffer 28(1) using the pointer received from the interrupt handler in the microprocessor. All pixel data in the accessed frame buffer 28(1) is passed through controller 24 to display 26 for actuation of corresponding pixels. When the microprocessor receives the next interrupt signal, it writes a new pointer to the controller indicative of the memory location of the next frame buffer 28(2). All pixel data in this second frame buffer 28(2) is likewise passed through controller 24 to display 26 for actuation of the corresponding pixels. In a similar fashion, controller 24 switches to the third frame buffer 28(3) upon receipt of a new pointer and all pixel data in the third frame buffer 28(3) is input to the display for actuation of corresponding pixels.

One complete display cycle yields a composite stream of pixel data from the three buffers. With respect to individual pixels, the composite stream consists of a first bit from frame buffer 28(1), a second bit from frame buffer 28(2), and a third bit from frame buffer 28(3). The three consecutive bits turn "on" or "off" the corresponding pixel at sufficient speed that the pixel appears to the human eye to have a grayscale shade representative of the fraction of time the pixel is "on" during the display cycle (i.e., during the three iterations). Pixels that appear lighter reflect longer "on" periods.

The LCD device implemented with three 1-bit/pixel frame buffers is capable of producing four grayscale shades, including white (i.e., $m\times(2^n-1)+1=3(2^1-1)+1=4$). Table 2 provides the possible shade variations for a single pixel that can be achieved by switching among three 1-bit/pixel frame buffers, represented as buffers A, B, and C in the Table, at each iteration during one display cycle.

TABLE 2

One Display Cycle of LCD Device Having Three 1-Bit/Pixel Frame Buffers For Single Pixel

| Display Iteration I | Display Iteration II | Display Iteration III | Grayscale Shade of Pixel |
|---|---|---|---|
| A = 0 | B = 0 | C = 0 | Black |
| A = 0 | B = 1 | C = 0 | Dark Gray |
| A = 1 | B = 0 | C = 1 | Light Gray |
| A = 1 | B = 1 | C = 1 | White |

The LCD device implemented with three 1-bit/pixel buffers consumes less power in comparison to the prior art single buffer LCD device that produces four grayscale shades (described above in the Background of the Invention section). To produce four shades, the prior art LCD device must repeatedly access two bits of data from the single frame buffer three different times during a single display cycle (see Table 1). The redundant memory reads of multiple bits consumes power.

In contrast, the LCD device of this invention only accesses one bit of data three times during the display cycle to enable production of four grayscale shades. This scheme reduces power consumption by approximately 50%. Moreover, there is less data congestion over data lines 30(1)–30(3), as compared to the data bussing in prior art LCD devices, further contributing to the efficiencies gained by this invention.

It is noted that the LCD device of this invention uses more memory than prior art LCD devices. In this example, the LCD device stores three sets of 1-bit/pixel data in comparison to the prior art LCD device which stores one set of 2-bits/pixel data, resulting in a 50% increase in memory capacity. However, an increase in memory size is less costly and consumes less power than the multiple unnecessary reads of the prior art LCD device, and is therefore a beneficial tradeoff.

Optimization Option 2: Increase Number of Grayscale Shades

The general multi-buffer LCD device of this invention can also be optimized to increase the number of grayscale shades. For purposes of explanation, suppose that LCD device 20 is configured with two 2-bit/pixel frame buffers 28(1) and 28(2). In one implementation, controller 24 selects the first frame buffer 28(1) during one display cycle and then switches to the second frame buffer 28(2) during the next display cycle. During each display cycle, the controller accesses each frame buffer three times (i.e., no. of accesses= $2^n-1=2^2-1=3$).

More specifically, the controller first selects, in response to the pointer written from microprocessor 34, the first frame buffer 28(1) and accesses the pixel data three repeated iterations I, II, III. The controller causes the pixels in display 26 to actuate the corresponding pixels according to the values stored in the first frame buffer 28(1). For example, the bit value "11" turns the pixel on during all three display iterations, "10" turns the pixel on two of the display iterations and off the third display iteration, "01" turns the pixel on only one of the display iterations and off the remaining two display iterations, and "00" leaves the pixel off during all three display iterations. The larger fraction of time the pixel is on during the frame cycle (i.e., during the three display iterations), the lighter the pixel appears. The frame buffer is repeatedly accessed at a rate of approximately 80 Hz, providing a display cycle rate of approximately 27 Hz.

The controller then selects the second frame buffer 28(2) and accesses its pixel data during three repeated iterations I, II, III. The controller causes the pixels in display 26 to actuate the corresponding pixels according to the values stored in the second frame buffer 28(2) in the manner just described above. Alternating between the two frame buffers during each display cycle yields a composite stream of pixel data consisting of an alternating pattern of bits from frame buffer 28(1) and bits from frame buffer 28(2). The alternating scheme produces a grayscale shade which is the average of the shades corresponding to the pixel data held in the two frame buffers.

It is noted that the frequency of switching between the two frame buffers following each complete display cycle is approximately 13 Hz (i.e., 27 Hz/2). This rate is still faster than the humanly perceptible 10 Hz. Thus, the pixel appears at a constant shade, and does not flicker.

The LCD device implemented with two 2-bit/pixel buffer is capable of producing a seven grayscale shades, including white (i.e., $m\times(2^n-1)+1=2(2^2-1)+1=7$), which is three more shades than the comparable prior art LCD device. Table 3 shows the results of combining data from two 2-bit/pixel frame buffers to produce seven shades 0–6 (with their average intensities shown in parentheses):

TABLE 3

Increased Shade Production of LCD Device Having Two 2-Bit/Pixel Frame Buffers

| Bits in Second Frame Buffer | Bits in First Frame Buffer 28(1) | | | |
|---|---|---|---|---|
| 28(2) | 00 | 01 | 10 | 11 |
| 00 | 0 (0) | 1 (0.5) | 2 (1) | 3 (1.5) |
| 01 | 1 (0.5) | 2 (1) | 3 (1.5) | 4 (2) |
| 10 | 2 (1) | 3 (1.5) | 4 (2) | 5 (2.5) |
| 11 | 3 (1.5) | 4 (2) | 5 (2.5) | 6 (3) |

Table 4 shows an example display cycle for the two 2-bit/pixel frame buffers implementation.

TABLE 4

Example Display Cycle of LCD Device Having Two 2-Bit/Pixel Frame Buffers

| Cycle 1 Access First Frame Buffer 28(1) | | | Cycle 2 Access Second Frame Buffer 28(2) | | | Grayscale Shade |
|---|---|---|---|---|---|---|
| I | II | III | I | II | III | Number |
| 00 | 00 | 00 | 00 | 00 | 00 | 0 |
| 00 | 00 | 00 | 01 | 01 | 01 | 1 |
| 01 | 01 | 01 | 01 | 01 | 01 | 2 |
| 01 | 01 | 01 | 10 | 10 | 10 | 3 |
| 10 | 10 | 10 | 10 | 10 | 10 | 4 |
| 10 | 10 | 10 | 11 | 11 | 11 | 5 |
| 11 | 11 | 11 | 11 | 11 | 11 | 6 |

In another implementation, the controller can switch between the two frame buffer each iteration to interleave the pixel data. This implementation requires a more complex controller which sorts out the interleaved stream of potentially different pixel from two separate frame buffers. The switching scheme according to this implementation is presented in Table 5. Again, first frame buffer 28(1) is represented as buffer "A" and second frame buffer 28(2) is represented as buffer "B".

TABLE 5

Example of Switching Between Two Frame Buffers Each Iteration to Interleave Pixel Data

| Cycle 1 | | | Cycle 2 | | | Grayscale Shade |
|---|---|---|---|---|---|---|
| I | II | III | I | II | III | Number |
| A = 00 | B = 00 | A = 00 | B = 00 | A = 00 | B = 00 | 0 |
| A = 00 | B = 01 | A = 00 | B = 01 | A = 00 | B = 01 | 1 |
| A = 01 | B = 01 | A = 01 | B = 01 | A = 01 | B = 01 | 2 |
| A = 01 | B = 10 | A = 01 | B = 10 | A = 01 | B = 10 | 3 |
| A = 10 | B = 10 | A = 10 | B = 10 | A = 10 | B = 10 | 4 |
| A = 10 | B = 11 | A = 10 | B = 11 | A = 10 | B = 11 | 5 |
| A = 11 | B = 11 | A = 11 | B = 11 | A = 11 | B = 11 | 6 |

The LCD device implemented with two 2-bit/pixel buffers provides three more shades in comparison to the prior art single frame buffer LCD device that produces just four grayscale shades (described above in the Background of the Invention section). The only cost is additional memory space. In this example, the LCD device uses twice as much storage space for frame buffers as compared to the prior art LCD. The benefit of improved quality for very little memory cost, however, is beneficial and warrants the tradeoff.

It is further noted that the multi-buffer 2-bit/pixel LCD device of this invention is significantly less costly than upgrading to a conventional 4-bit/pixel LCD device that is capable of 16 grayscale shades. This invention therefore provides improved performance of additional shades without resorting to higher component costs.

The multi-buffer LCD device of this invention also permits other possible variations which further increase the number of grayscale shades. For example, the LCD controller might be programmed to access the first frame buffer 28(1) for two consecutive display cycles and then to access the second frame buffer 28(2) for only one display cycle. This scheme would yield ten grayscale shades, as shown in FIG. 6.

TABLE 6

Modified Display Cycles of LCD Device Having Two 2-Bit/Pixel Frame Buffers

| Cycle 1 Access First Frame Buffer 28(1) | | | Cycle 2 Access First Frame Buffer 28(1) | | | Cycle 3 Access Second Frame Buffer 28(2) | | | Grayscale Shade |
|---|---|---|---|---|---|---|---|---|---|
| I | II | III | I | II | III | I | II | III | Number |
| 00 | 00 | 00 | 00 | 00 | 00 | 00 | 00 | 00 | 0 |
| 00 | 00 | 00 | 00 | 00 | 00 | 01 | 01 | 01 | 1 |
| 01 | 01 | 01 | 01 | 01 | 01 | 00 | 00 | 00 | 2 |
| 01 | 01 | 01 | 01 | 01 | 01 | 01 | 01 | 01 | 3 |
| 01 | 01 | 01 | 01 | 01 | 01 | 10 | 10 | 10 | 4 |
| 10 | 10 | 10 | 10 | 10 | 10 | 01 | 01 | 01 | 5 |
| 10 | 10 | 10 | 10 | 10 | 10 | 10 | 10 | 10 | 6 |
| 10 | 10 | 10 | 10 | 10 | 10 | 11 | 11 | 11 | 7 |
| 11 | 11 | 11 | 11 | 11 | 11 | 10 | 10 | 10 | 8 |
| 11 | 11 | 11 | 11 | 11 | 11 | 11 | 11 | 11 | 9 |

In this situation, the interrupt handler first writes the memory pointer for first frame buffer 28(1). The controller uses the pointer to access the pixel data in the first frame buffer 28(1) during three repeated iterations I, II, III. The controller causes the pixels in display 26 to actuate the corresponding pixels according to the values stored in the first frame buffer 28(1) in the manner described above with respect to Tables 3 and 4. The frame buffer is repeatedly accessed at a rate of approximately 80 Hz, providing a display cycle rate of approximately 27 Hz.

On the second display cycle, the interrupt handler in microprocessor 34 writes the same memory pointer indicative of the first frame buffer 28(1) to the controller. The controller again accesses the pixel data from first frame buffer 28(1) for three more repeated iterations I, II, III. The controller causes the pixels in display 26 to actuate the corresponding pixels according to the values stored in the first frame buffer 28(1).

On the third display cycle, the interrupt handler writes the memory pointer to the second frame buffer 28(2). The controller switches to the second frame buffer and accesses its pixel data for three repeated iterations I, II, III. The pixels in display 26 are thus actuated based upon the pixel data in the second frame buffer.

The switching scheme of twice selecting the first frame buffer 28(1) and then once selecting the second frame buffer 28(2) yields a composite stream of pixel data that produces a grayscale shade which is the average of the grayscale shades generated over three complete display cycles.

For the LCD device implemented with two 2-bit/pixel frame buffers, five color palettes are available: (1) four colors are producible using only the first frame buffer 28(1); (2) four colors can be provided using only the second frame buffer 28(2); (3) seven colors can be generated by toggling equally between the two frame buffers, as shown in Tables 3–5; (4) ten colors can be generated by unequally toggling between the two frame buffers where the first frame buffer 28(1) is accessed twice as often as second frame buffer 28(2), as explained above in Table 6; and (5) ten colors can be generated by unequally toggling between the two frame buffers where the first frame buffer 28(1) is accessed one-half as often as second frame buffer 28(2).

The multi-frame buffer LCD device of this invention is advantageously adaptable. It permits optimization toward power saving features or an increased number of shades in comparison to comparable prior art LCD devices. The benefits are gained at only the cost of additional memory, which is typically insignificant in light of the benefits.

Figure 3:
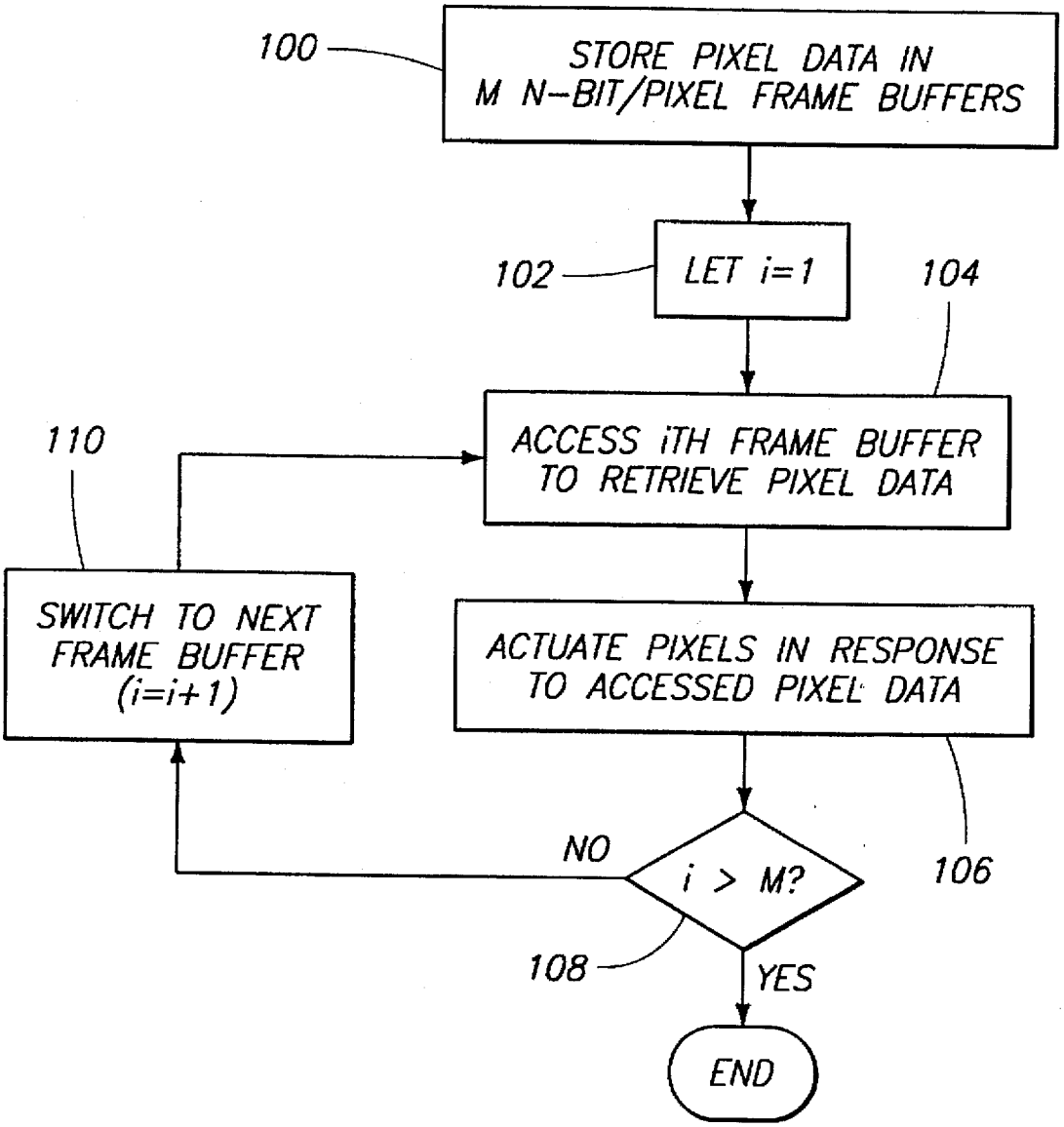
FIG. 3 is a flow chart of preferred steps for operating an LCD device of this invention.

FIG. 3 shows a preferred method for operating an LCD device of this invention. The illustrated steps perform one complete display cycle where all frame buffers are accessed at least one time. At step 100, pixel data is stored in the m n-bit/pixel frame buffers 28(1)–28(m). A first or i'th frame buffer (where i=1, . . . , m) is then selected and accessed by the controller 24 to retrieve the pixel data (steps 102 and 104). Preferably, the controller repeatedly accesses the frame buffer $2^n-1$ times. The pixel data is forwarded from the controller 24 to the display 26 where it is used to actuate the pixel (step 106). Once the controller has finished accessing the first or i'th frame buffer, it switches to the next frame buffer (steps 108 and 110) to access the next set of pixel data therein.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A driver for a visual display device, comprising:

m n-bit/pixel frame buffers to hold m sets of pixel data, where m>1 and n>1; and an n-bit controller for switching among the m n-bit/pixel frame buffers at a selected rate during a display cycle to output a composite stream of the m sets of pixel data capable of producing a number of various grayscale shades, the number of grayscale shades, including white, being as follows:

$$\text{No. of Shades}=m\times(2^n-1)+1.$$

2. A driver for a visual display device comprising:

m n-bit/pixel frame buffers to hold m sets of pixel data, where m>1 and n>1; and an n-bit controller for switching among the m n-bit/pixel frame buffers at a selected rate during a display cycle to output a composite stream of the m sets of pixel data, the controller accessing each n-bit/pixel frame buffer multiple times during the display cycle wherein the number of accesses made by the controller is as follows:

$$\text{No. of Accesses}=(2^n-1).$$

3. A driver for a visual display device according to claim 2 wherein the selected rate is greater than or equal to 10 Hz.

4. A driver for a visual display device, comprising:

two 2-bit/pixel frame buffers (m=2, n=2) to hold two sets of pixel data; and a 2-bit controller for switching among the two 2-bit/pixel frame buffers at a selected rate during a display cycle such that the controller three times accesses the two bits of pixel data in each frame buffer during the display cycle; and the driver being capable of producing seven grayscale shades.

5. A visual display device, comprising:

m n-bit/pixel frame buffers to hold m sets of pixel data, where m>1 and n>1;

an n-bit controller for switching among the m n-bit/pixel frame buffers at a selected rate during a display cycle to output a composite stream of the m sets of pixel data;

a display coupled to the controller to receive the composite stream, the display having a matrix of pixels which turn on and off in response to the pixel data, individual pixels having a grayscale shade reflecting an average duration that the individual pixel is on; and the visual display device producing a number of grayscale shades, including white, as follows:

$$\text{No. of Shades}=m\times(2^n-1)+1.$$

6. A visual display device according to claim 5 wherein the controller accesses each n-bit/pixel frame buffer multiple times during the display cycle.

7. A visual display device according to claim 6, wherein the number of accesses made by the controller is as follows:

$$\text{No. of Accesses}=(2^n-1).$$

8. A visual display device according to claim 5 wherein the selected rate is greater than or equal to 10 Hz.

9. A visual display device, comprising:

two 2-bit/pixel frame buffers (m=2, n=2) to hold two sets of pixel data;

a 2-bit controller for switching among the two 2-bit/pixel frame buffers at a selected rate during a display cycle such that the controller three times accesses the two bits of pixel data in each frame buffer during the display cycle to output a composite stream;

a display coupled to the controller to receive the composite stream, the display having a matrix of pixels which turn on and off in response to the pixel data, individual pixels having a grayscale shade reflecting an average duration that the individual pixel is on; and the visual display device being capable of producing seven grayscale shades.

10. A method for operating a visual display device, comprising the following steps:

storing m sets of pixel data in m n-bit/pixel frame buffers, where m>1;

switching among the m frame buffers during a display cycle;

intermittent of said switching, accessing each of the m frame buffers multiple times during the display cycle to retrieve a corresponding set of pixel data; and displaying pixels having one of $m\times(2^n-1)+1$ grayscale shades reflecting an average of the m sets of pixel data retrieved from the m frame buffers.

11. A method for operating a visual display device, comprising the following steps:

storing m sets of pixel data in m n-bit/pixel frame buffers, where m>1;

switching among the m frame buffers during a display cycle;

intermittent of said switching, accessing each of the m frame buffers $2^n-1$ times during the display cycle, where n>1, to retrieve a corresponding set of pixel data; and displaying pixels having grayscale shades reflecting an average of the m sets of pixel data retrieved from the m frame buffers.

12. A method for operating a visual display device, the visual display device having m n-bit/pixel frame buffers to hold m sets of pixel data, where m>1 and n>1, and an n-bit controller for switching among the m n-bit/pixel frame buffers, the method comprising the following steps:

switching among the m frame buffers at a selected rate during a display cycle; and intermittent of said switching, accessing each of the m frame buffers $2^n-1$ times during the display cycle to produce a composite stream of the m sets of pixel data capable of producing $m\times(2^n-1)+1$ grayscale shades, including white.

* * * * *